US011655692B2

(12) United States Patent
Wood et al.

(10) Patent No.: US 11,655,692 B2
(45) Date of Patent: May 23, 2023

(54) SHAPED CHARGE ORIENTATION

(71) Applicant: Halliburton Energy Services, Inc., Houston, TX (US)

(72) Inventors: Stuart Michael Wood, Kingwood, TX (US); Darren Philip Walters, Burleson, TX (US); Matthew Kinter, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/550,816

(22) Filed: Dec. 14, 2021

(65) Prior Publication Data

US 2022/0403717 A1 Dec. 22, 2022

Related U.S. Application Data

(60) Provisional application No. 63/212,464, filed on Jun. 18, 2021.

(51) Int. Cl.

| | |
|---|---|
| ***E21B 43/117*** | (2006.01) |
| ***E21B 43/119*** | (2006.01) |
| ***E21B 43/116*** | (2006.01) |

(52) U.S. Cl.

CPC ..... *E21B 43/117* (2013.01); *E21B 43/116* (2013.01); *E21B 43/119* (2013.01)

(58) Field of Classification Search

CPC ..... E21B 43/116; E21B 43/117; E21B 43/119
See application file for complete search history.

(56) References Cited

U.S. PATENT DOCUMENTS

| | | | | |
|---|---|---|---|---|
| 3,143,170 | A * | 8/1964 | Nelson | E21B 47/09 166/255.2 |
| 6,662,883 | B2 | 12/2003 | Bonkowski | |
| 8,443,886 | B2 | 5/2013 | Torres et al. | |
| 10,208,573 | B2 | 2/2019 | Von Kaenel et al. | |
| 10,669,821 | B2 | 6/2020 | Knight et al. | |
| 10,781,675 | B2 | 9/2020 | Von Kaenel et al. | |

(Continued)

FOREIGN PATENT DOCUMENTS

| | | |
|---|---|---|
| EP | 3105413 | 3/2020 |

OTHER PUBLICATIONS

International Search Report and Written Opinion for Application No. PCT/US2021/064783, dated Apr. 6, 2022.

*Primary Examiner* — Yong-Suk (Philip) Ro
(74) *Attorney, Agent, or Firm* — John Wustenberg; C. Tumey Law Group PLLC

(57) ABSTRACT

Systems and methods of the present disclosure generally relate to orienting perforation systems for subterranean operations. An alignment system comprises a first component coupled to a charge tube, the first component operable to rotate in concert with the charge tube, wherein an axis of rotation of the first component extends in a direction of the longitudinal axis of the first component; a second component nested within the first component or disposed within a gun body, wherein the charge tube is movably disposed within the gun body; and an electrical contact extending through the first and second components, wherein the first component is further operable to move in axial directions within the gun body and along the electrical contact to interlock with the second component or separate from the second component.

20 Claims, 6 Drawing Sheets

(56) References Cited

U.S. PATENT DOCUMENTS

| | | | | |
|---|---|---|---|---|
| D903,064 | S | 11/2020 | Mulhern et al. | |
| 2004/0216866 | A1 | 11/2004 | Barlow et al. | |
| 2007/0084336 | A1 | 4/2007 | Neves | |
| 2010/0230163 | A1 | 9/2010 | Hales et al. | |
| 2015/0226043 | A1 | 8/2015 | Hardesty et al. | |
| 2016/0290084 | A1 | 10/2016 | LaGrange et al. | |
| 2020/0157924 | A1 | 5/2020 | Melhus et al. | |
| 2020/0248535 | A1* | 8/2020 | Goyeneche | E21B 43/119 |
| 2022/0003086 | A1* | 1/2022 | Roessler | E21B 43/119 |

* cited by examiner

SHAPED CHARGE ORIENTATION

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Traditionally the casing string is cemented to the wellbore. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. Once the perforating gun system is in position such that shaped charges are disposed adjacent to a subterranean formation having hydrocarbons, the shaped charges are detonated. The detonation perforates the casing string, the cement, and the subterranean formation such that hydrocarbons may flow into the casing string via the perforations.

In some cases, operators are interested in perforating wells with phased shots where all shaped charges are pointed toward a predetermined orientation of a horizontal or inclined well. Typically, this may be achieved with externally adjustable lock rings on the perforating carrier or connecting tandems, or with internally weighted charge tubes that are mounted on bearings. However, these techniques may have their disadvantages. For example, in weighted/bearing systems, re-positioning and/or adjusting the shaped charges to modify the orientations of the shaped charges within the wellbore after initial installation may require disassembly of the perforating guns. That is, the rotating members and other perforating gun components must be removed from the perforating gun bodies to provide access to re-position and/or adjust the shaped charge holders, replace the rotating member, etc. Unfortunately, removing rotating members and other perforating gun components to adjust the orientations of the shaped charges is costly, time consuming, and may hinder efficiency of perforation operations.

In some cases, operators are interested in perforating wells with phased shots where all shaped charges are pointed toward a predetermined orientation of a horizontal or inclined well. Typically, this may be achieved with externally adjustable lock rings on the perforating carrier or connecting tandems, or with internally weighted charge tubes that are mounted on bearings.

However, these techniques may have their disadvantages. For example, in weighted/bearing systems, re-positioning and/or adjusting the shaped charges to modify the orientations of the shaped charges after initial installation of the charge tube may require disassembly of the perforating guns. That is, the rotating members and other perforating gun components must be removed from the perforating gun bodies to provide access to re-position and/or adjust the shaped charge holders, replace the rotating member, etc. Unfortunately, removing rotating members and other perforating gun components to adjust the orientations of the shaped charges is costly, time consuming, and may hinder efficiency of perforation operations.

The external lock ring systems may only need the carrier to be rotated and the charges may stay aligned with scallops on the perforating gun. However, the external lock rings require that all of the carriers are aligned and remain aligned during tightening of the lock rings. Further, wrenches are required to hold the carriers in place during tightening of the lock rings to prevent backing off of the carriers during torquing. Some systems also require a set screw to be tightened to keep the lock ring from backing off.

BRIEF DESCRIPTION OF THE DRAWINGS

These drawings illustrate certain aspects of some of the examples of the present disclosure and should not be used to limit or define the method.

DETAILED DESCRIPTION

Figure 1:
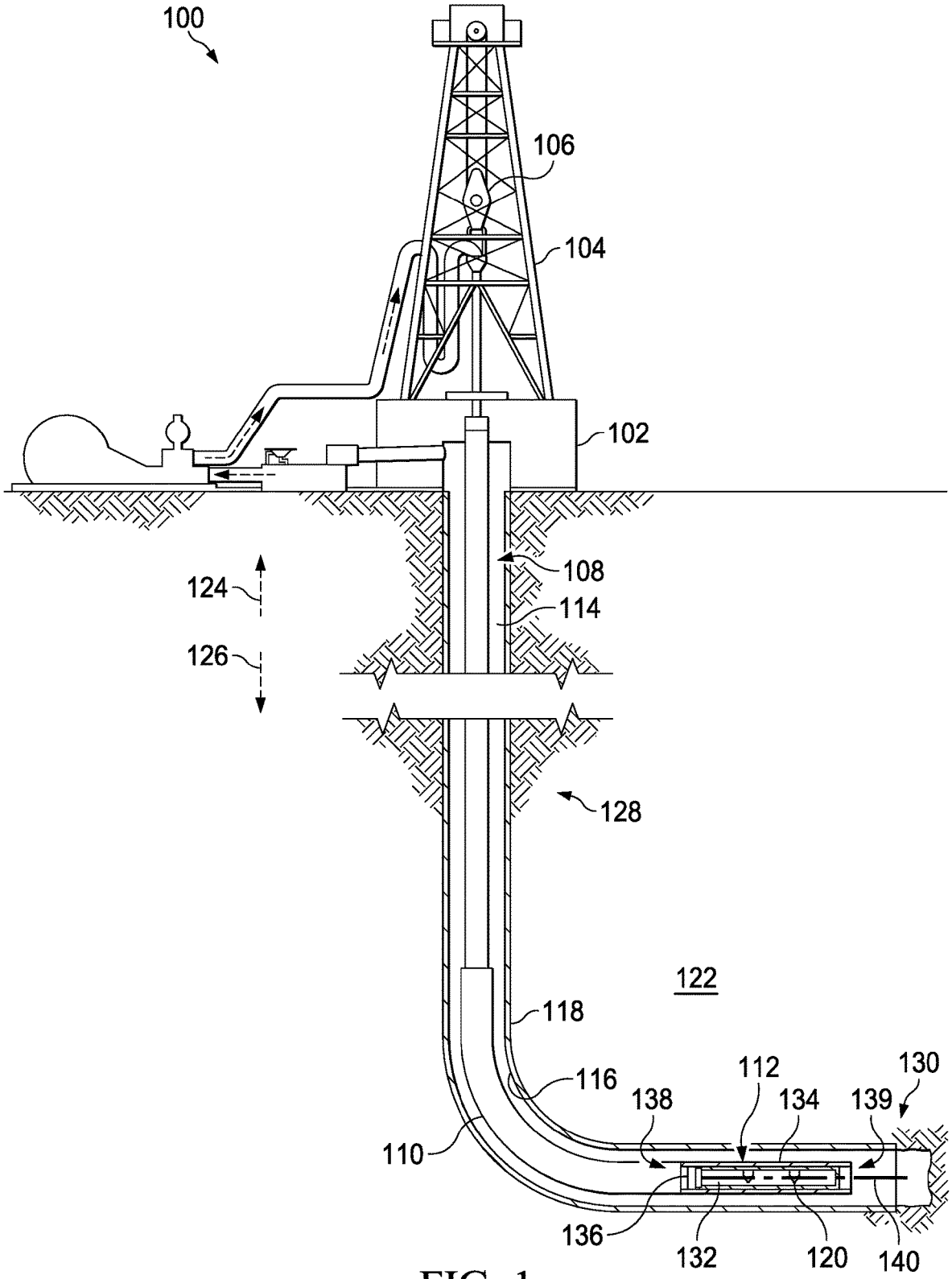
FIG. 1 illustrates an operational environment, in accordance with examples of the present disclosure.

Provided are systems and methods for adjusting a perforating assembly for subterranean operations. Particularly, the systems and methods are directed to an adjustable end alignment assembly that may attach to the shaped charge holder/tube inside the perforating gun body/carrier, to allow a field crew to dial-in/set the orientation of the shaped charges as desired.

In some examples, the end alignment assembly may include two components that nest/interlock together at an end of the charge tube and the gun carrier. A first component may be coupled to the charge tube and a second component may be disposed within the gun carrier. The first component may be disposed concentrically or eccentrically within the second component, and each component may be of a tubular or circular shape to allow rotation of the first component within the second component. Additionally, each component may include a section to allow the charge tube to be adjusted/rotated to the desired orientation, without bearings and lock rings. For example, the first component may include a section with teeth, for example, in the form of a spline feature along an external circumference, and the second component may include a second spline feature along an internal circumference to allow nesting of the first component within the second component. Also, in some examples, a ratcheting mechanism may be employed to ratchet/rotate the charge tube as desired.

In some examples, an electrical contact may secure the first and second components. The electrical contact may pass through both components and may include a portion/feature (e.g., a groove) for receiving a fastener. Non-limiting examples of the fastener include a retaining clip, a retaining nut, or a hole and pin, among others. The fastener may be disposed on the electrical contact to secure the first and second components. The electrical contact may also include a feature for attaching a wire (e.g., a tubular extension) to communicate with other perforating guns.

In particular examples, the first and second components may be nested together before the charge tube is inserted into the carrier. A spring feature may urge the components together and prevent the charge tube from moving until desired. The spring feature may also prevent the first and second components from falling out of the carrier. The electrical contact may include a spring.

For example, the charge tube may be pulled slightly to separate the first component from the second component. The charge tube may then be turned to the desired orientation and the spring pulls or otherwise urges the components back together in the nested configuration. With the next/adjacent perforating gun attached, the charge tube may no longer be adjusted. Thus, as part of the rotation technique, in some examples, an outer section of the gun carrier may be marked (e.g., via a paint pen) to indicate an orientation of the shaped charges (e.g., the direction the charges are facing).

In other examples, the second component may be disposed within the carrier before inserting the charge tube, such that the charge tube may not be secured within the carrier until attachment of the next perforating gun.

In some examples, the alignment assembly may be constructed from injection-molded plastic with an electrical contact made of any suitable conductive material such as brass, for example. In other examples, the alignment assembly may be made of metal and the electrical contact is insulated.

FIG. 1 illustrates an operational environment 100, in accordance with examples of the present disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure.

As illustrated, the operational environment 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of the work string 110 for supporting the perforating gun system 112.

The work string 110 is configured to lower the perforating gun system 112 into a wellbore 114. As illustrated, the wellbore 114 may be lined with casing 116 cemented to a wellbore wall 118. The casing 116 is configured to protect the wellbore 114 from failure (e.g., collapse, erosion) and to provide a fluid path for hydrocarbons during production. To access the hydrocarbons, the work string 110 lowers the perforating gun system 112 to a position such that shaped charges 120 are disposed adjacent to a subterranean formation 122 having the hydrocarbons, and the perforating gun system 112 detonates the shaped charges 120.

In some examples, the shaped charges 120 may be sequentially detonated by the perforating gun system 112 in a downhole to up-hole direction 124 or an up-hole to downhole direction 126. The detonations perforate the casing 116, the cementing, and the subterranean formation 122 in the respective paths of the shaped charge detonations such that hydrocarbons may flow into the casing 116 string via the perforations.

The wellbore 114 has a vertical portion 128 and a horizontal portion 130 with the perforating gun system 112 being disposed in the horizontal portion 130. In some examples, the perforating gun system 112 may be disposed in the vertical portion 128. The perforating gun system 112 includes a charge tube 132 (e.g., a rotating member holding the shaped charges 120) rotatably mounted within a gun body 134 of the perforating gun system 112. The rotation may be relative to a longitudinal axis 140 of the perforating gun system 112.

In particular examples, the perforating gun system 112 may include an adjustable end alignment assembly 136 ("alignment assembly 136"). The alignment assembly 136 may be disposed within the gun body 134 at an end 138 (e.g., proximal end) or an end 139 (e.g., distal end).

Figure 2:
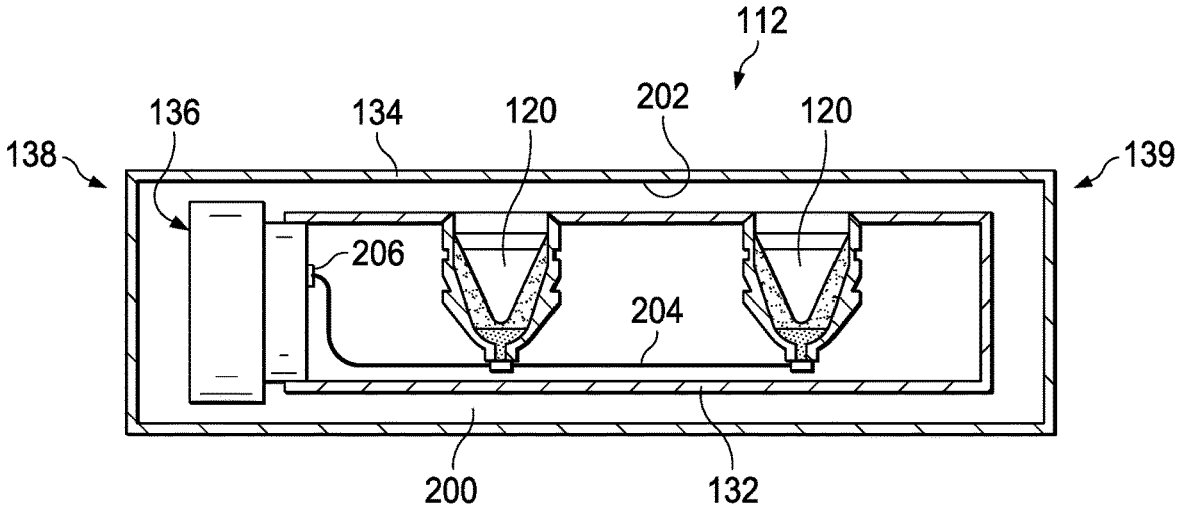
FIG. 2 illustrates a close-up view of a perforating gun system, in accordance with examples of the present disclosure.

FIG. 2 illustrates a close-up view of the perforating gun system 112, in accordance with examples of the present disclosure. As set forth above, the perforating gun system 112 includes the gun body 134 (e.g., a gun carrier). The gun body 134 is configured to house the charge tube 132. In the illustrated example, the charge tube 132 includes a generally cylindrical shape. However, the charge tube 132 may include any suitable shape that permits rotation of the charge tube 132 within an interior portion 200 of the gun body 134. For example, the charge tube 132 may include an elliptical profile so long as the charge tube 132 may rotate within the gun body 134 without contacting an interior surface 202 of the gun body 134. Contact between the charge tube 132 and gun body 134 may hinder or prevent rotation of the charge tube 132.

The alignment assembly 136 may be disposed within the gun body 134 at the end 138 (e.g., proximal end) or the end 139 (e.g., distal end). The alignment assembly 136 may be attached to the charge tube 132 and the gun body 134. The perforating gun system 112 also includes the at least one shaped charge 120. As set forth above, the shaped charge 120 may be disposed within the charge tube 132. A wire 204 may be disposed within the charge tube 132 to allow communication between a series of perforating guns. The wire 204 may be in communication with an electrical contact 206 of the alignment assembly 136.

Figure 3A:
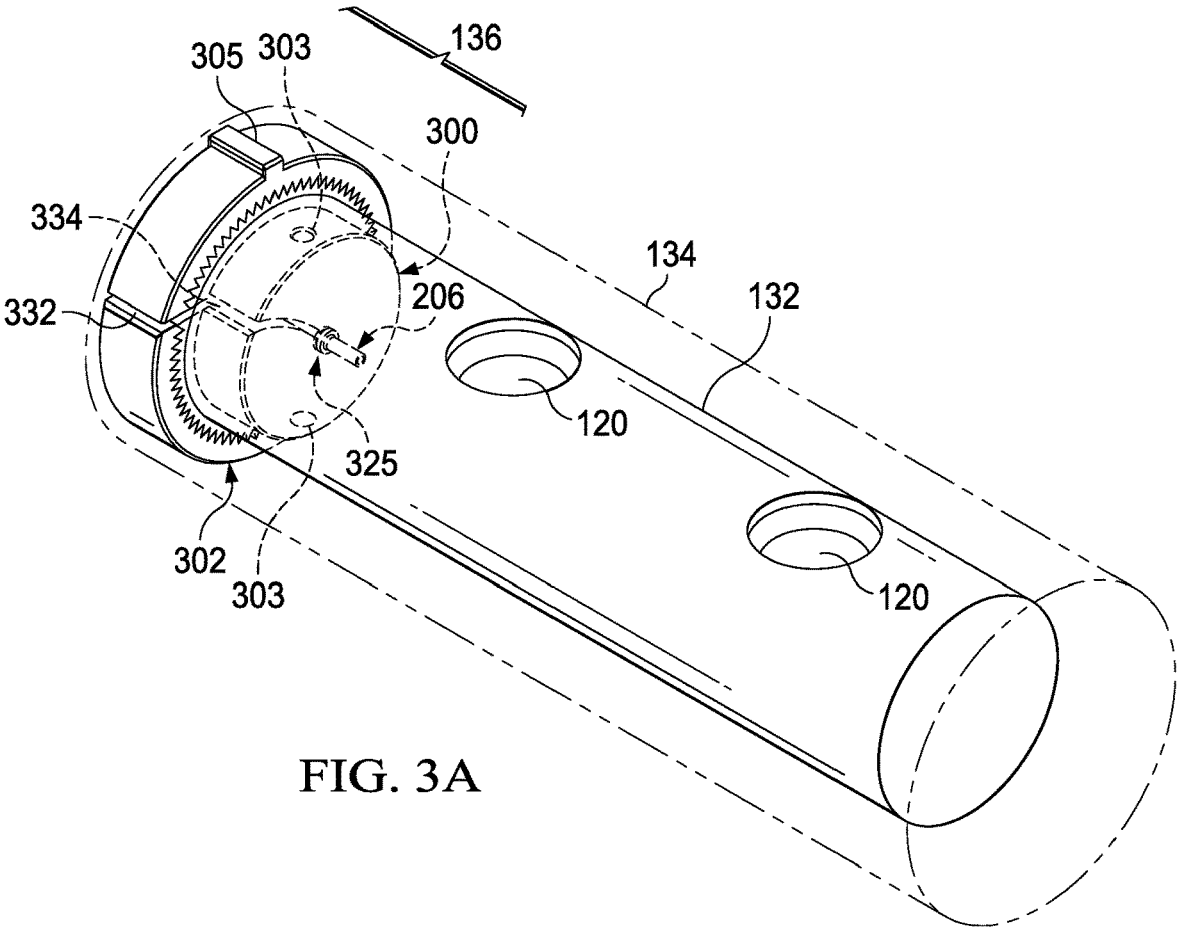
FIGS. 3A and 3B illustrate close-up views of a perforating gun alignment assembly, in accordance with examples of the present disclosure.
Figure 3B:
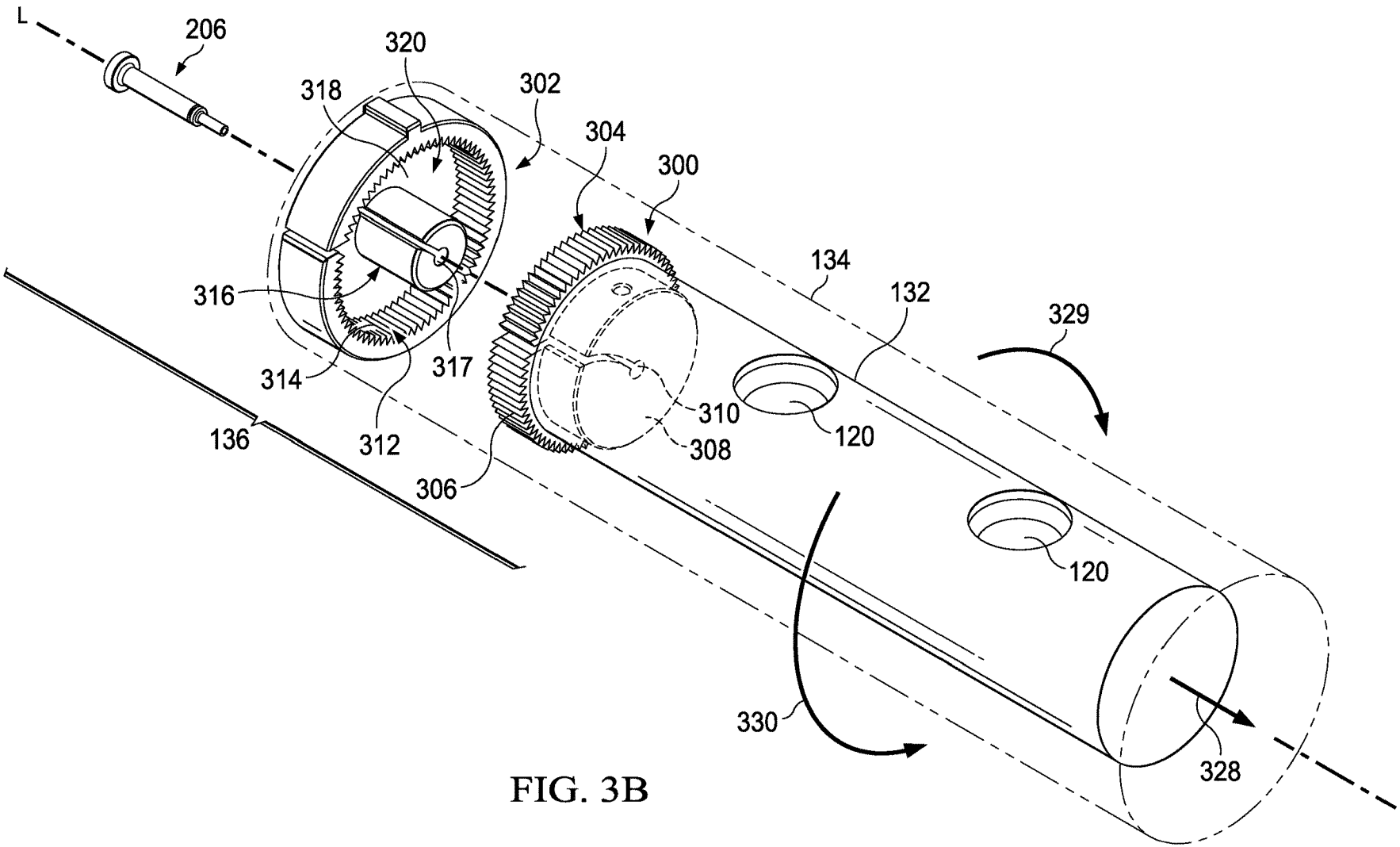

FIGS. 3A and 3B illustrate close-up views of the alignment assembly 136, in accordance with examples of the present disclosure. In some examples, the alignment assembly 136 may include two components 300 and 302 that may nest/interlock together. In some examples, the two components 300 and 302 may be constructed from injection-molded plastic. In other examples, the components 300 and 302 may be made of metal, however, the electrical contact 206 may be insulated.

A first component 300 may be coupled to the charge tube 132 and a second component 302 may be disposed within the gun body 134. In some examples, the first component 300 may be coupled to the charge tube 132 via a fastener (e.g., a screw) disposed through one or more apertures 303 of the first component 300. In some examples, the apertures 303 may be disposed on opposite sides of the alignment assembly 136. The second component 302 may be disposed within the gun body 134, for example, such that the second component 302 does not rotate. Rotation may be prevented with any suitable feature such as a ridge 305, for example. The first component 300 may be disposed concentrically or eccentrically within the second component 302, and each component may be of a tubular or circular shape to allow rotation of the first component 300 within the second component 302. Each of the first component 300 and the second component 302 may include a section with a mating surface, such as teeth, for example, to allow the charge tube 132 to be adjusted/rotated to the desired orientation, without bearings and lock rings. In some examples, the charge tube 132 may be segmented rather than a continuous tube.

For example, as best shown on FIG. 3B, the first component 300 may include a section 304 with teeth 306 in the form of a spline. The teeth 306 may be disposed along an external circumference of the section 304. The first component 300 may also include a cap 308 with a passage 310. The passage 310 may extend through a center of the cap 308 along a longitudinal axis L. The teeth 306 and spacing therebetween may be of any suitable profile, shape, and/or size.

The second component 302 may include a section 312 with teeth 314 disposed along an internal circumference in the form of a spline, for example, to allow nesting of the first component 300 within the second component 302. The teeth 314 and spacing therebetween may be of any suitable profile, shape, and/or size.

A protrusion 316 may extend from a base 318 forming a cavity 320 between the teeth 314 and the protrusion 316. The protrusion 316 may include a passage 317 also extending in a direction of L. The passage 317 may be coaxially aligned with the passage 310 to receive the electrical contact 206. For example, the first component 300 may receive the protrusion 316 within the cap 308 such that the teeth 306 and 314 are nested together such that the electrical contact 206 is disposed at centers of both the first component 300 and the second component 302 via the passages 310 and 317. In some examples, a fastener 325 may secure the electrical contact 206 within the alignment assembly 136, as best shown on FIG. 3A. Non-limiting examples of the fastener 325 may include a retaining clip, a retaining nut, and/or a hole and pin, among others.

Additionally, in some examples, the electrical contact 206 may be spring-loaded to urge the first component 300 and the second component 302 together. For example, the charge tube 132 may be pulled slightly (indicated by directional arrow 328) to separate the first component 300 from the second component 302. The charge tube 132 may then be rotated clockwise (indicated by directional arrow 329) or counterclockwise (indicated by directional arrow 330) to the desired orientation. An axis of rotation may extend along L. After orienting the charge tube 132, the spring may pull or otherwise urge the components 300 and 302 back together in the nested/interlocked configuration. With a next/adjacent perforating gun attached, the charge tube 132 may no longer be adjusted. Thus, as part of the rotation technique, in some examples, an outer section of the gun body 134 may be marked (e.g., via a paint pen) to indicate an orientation of the shaped charges 120 (e.g., the direction the shaped charges 120 are facing).

In particular examples, as best shown on FIG. 3A, each of components 300 and 302 may include slots such as slots 332 and 334 to facilitate installation or removal of the electrical contact 206, when aligned. In some examples, the slots 332 and 334 extend radially from a center of each of the components.

Figure 4A:
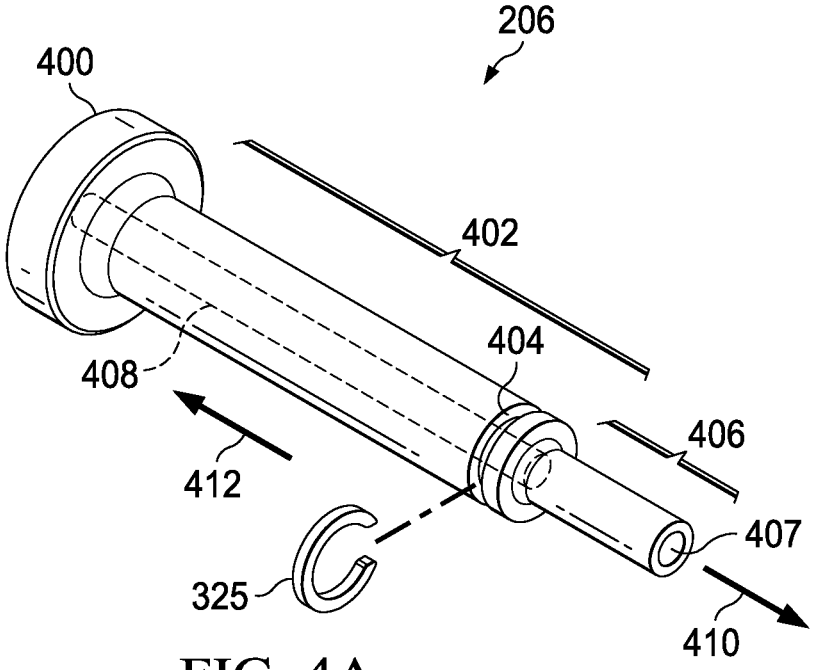
FIG. 4A illustrates a close-up view of a spring-loaded electrical contact, in accordance with examples of the present disclosure.

FIG. 4A illustrates a close-up view of the electrical contact 206, in accordance with examples of the present disclosure. As previously noted, the electrical contact 206 may include a head 400. The head 400 may be of any suitable shape, such as, for example, circular or tubular. An elongated portion 402 may extend from the head 400. A diameter of the head 400 may be greater than a diameter of the elongated portion 402. The elongated portion 400 may include a portion 404 (e.g., a groove) at a distal end of the elongated portion 402 to receive the fastener 325 to secure the electrical contact 206 within the spline features of the alignment assembly 136 (e.g., shown on FIG. 3A).

The electrical contact 206 may also include a second elongated portion 406 extending from the elongated portion 402. The head 400, the elongated portion 402, and the second elongated portion 406 may be coaxially aligned. The second elongated portion 406 may be utilized for attaching a wire. For example, a diameter and length of the second elongated portion 406 may be less than a diameter and length of the elongated portion 402 and may include a hollow portion 407 for wire accommodation.

Figure 4B:
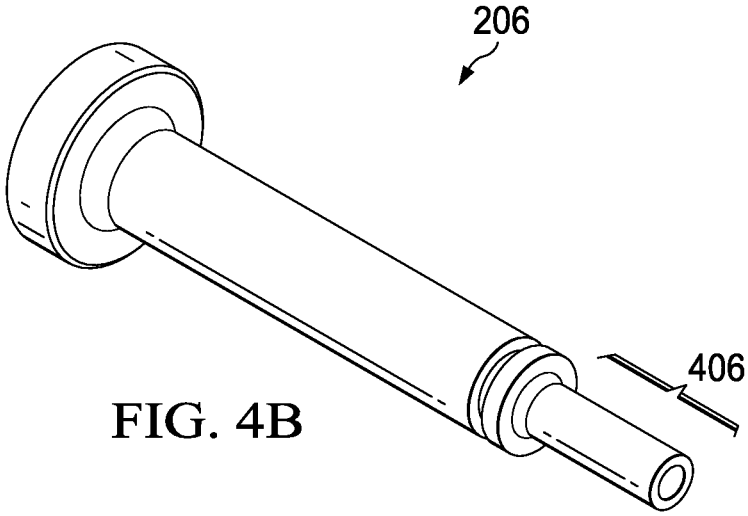
FIG. 4B illustrates a close-up view of an electrical contact without a spring, in accordance with examples of the present disclosure.

In some examples, the electrical contact 206 may be spring-loaded to urge the first component 300 and the second component 302 together after orientation/rotational adjustment of the charge tube 132 (e.g., shown on FIGS. 3A and 3B). For example, the second elongated portion 406 may be movably disposed within the elongated portion 402. A spring 408 may be disposed within the elongated portion 402 between the head 400 and the second elongated portion 406. As, the charge tube 132 is pulled in a direction 410, the spring 408 may compress. After, the charge tube 132 has been rotated, the spring 408 may expand in the opposite direction 412 thereby urging the first component 300 and the second component 302 together. The fastener 325 may be disposed within the portion 404 to retain the first component 300 and the second component 302 between the head 400 and the fastener 325 during rotation of the charge tube 132. In other examples, as shown on FIG. 4B, the electrical contact 206 does not include the spring 408 and the elongated portion 406 is not movable.

Figure 5:
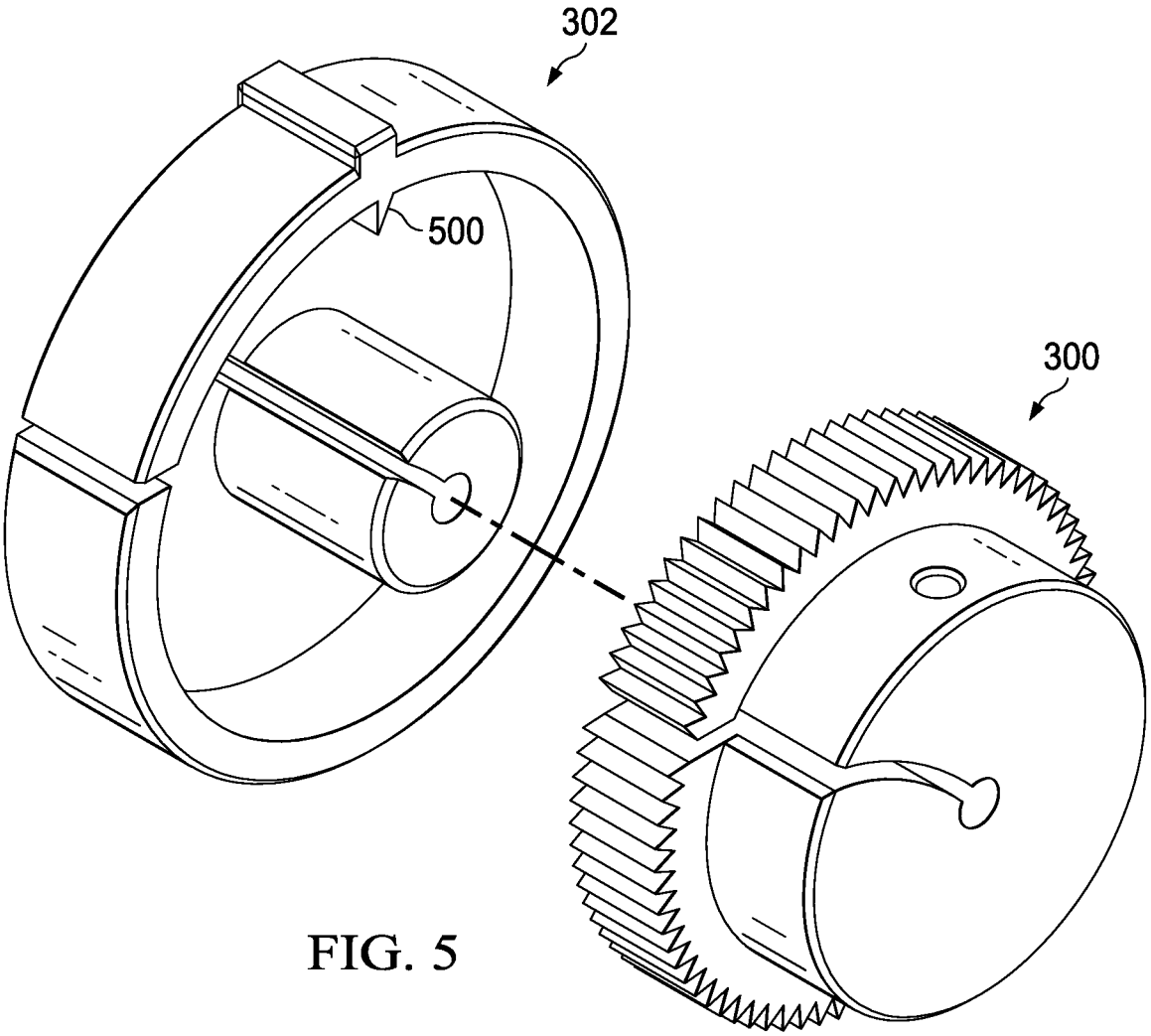
FIG. 5 illustrates a ratcheting mechanism for orienting the charge tube, in accordance with examples of the present disclosure.

FIG. 5 illustrates another example of the first component 300 and the second component 302, in accordance with examples of the present disclosure. As illustrated, the inner section of the second component 302 includes at least one ratcheting member 500 to allow adjustment of the charge tube 132 (e.g., shown on FIG. 3A) via rotation of the first component 300 either in a clockwise or counterclockwise direction. In some examples, the ratcheting member 500 may be disposed on the first component 300.

Figure 6:
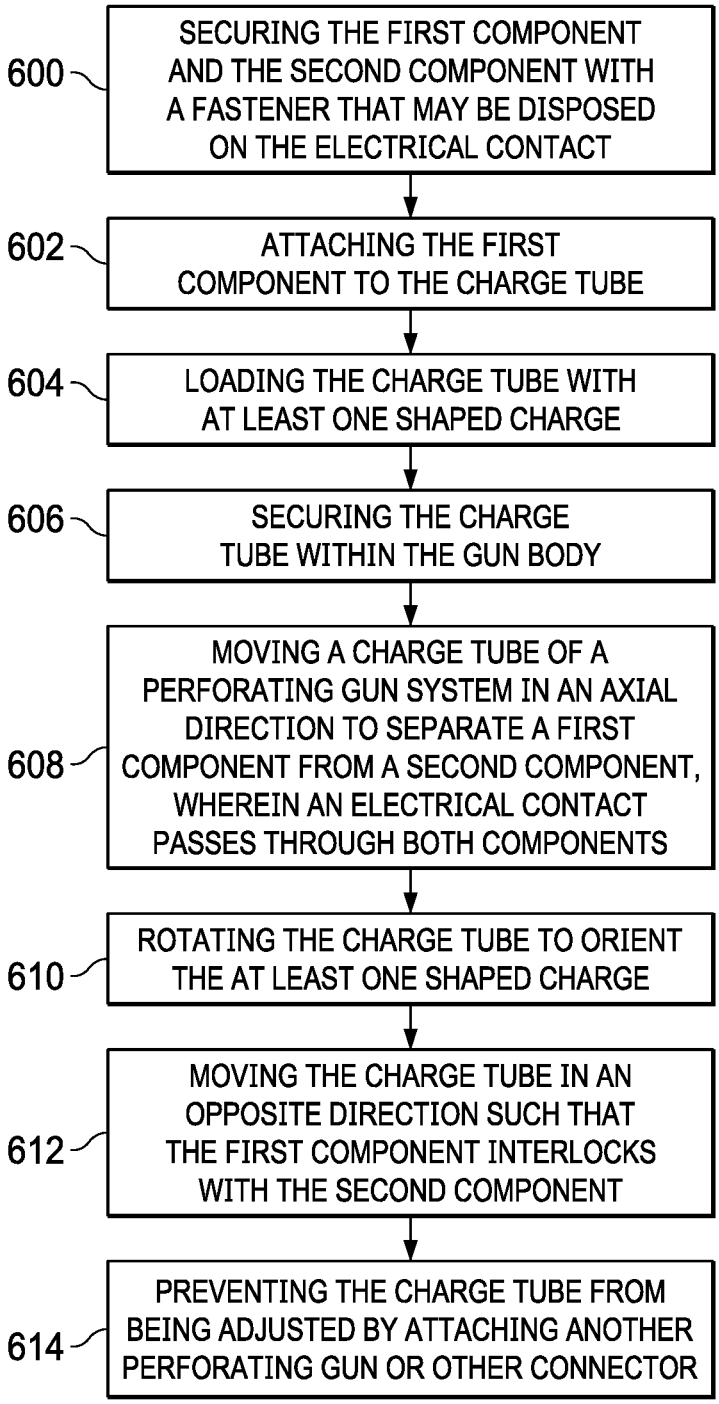
FIG. 6 illustrates an operative sequence for orienting a charge tube of the perforating gun system, in accordance with examples of the present disclosure.

FIG. 6 illustrates an operative sequence for adjusting a charge tube of a perforating gun system, in accordance with examples of the present disclosure. At step 600: the first component 300 and the second component 302 may be secured with a fastener 325 that may be disposed on the electrical contact (e.g., best shown on FIG. 3A).

At step 602: the first component 300 may be attached to the charge tube 132 (e.g., via the apertures 303 shown on FIG. 3A). At step 604: the charge tube 132 may be loaded with at least one shaped charge 120 (e.g., shown on FIGS. 3A and 3B).

At step 606: the charge tube 132 may be secured within the gun body 134 (e.g., via the ridge 305). At step 608, a charge tube of a perforating gun system (e.g., the charge tube 132 shown on FIGS. 3A and 3B) may be moved in an axial direction to separate a first component from a second component (e.g., the first component 300 and the second component 302 shown on FIGS. 3A and 3B), wherein the electrical contact 206 passes through both components. In some examples, the second component 302 may be disposed within the gun body 134 before inserting the charge tube 132.

At step 610, the charge tube 132 may be rotated to orient the shaped charge(s) 120. At step 612, the charge tube 132 may be moved in an opposite direction such that the first component 300 interlocks with the second component 302, as shown on FIG. 3A, for example. At step 614: the charge tube 132 may be prevented from being adjusted by attaching another perforating gun or other connector.

Accordingly, the present disclosure provides systems and methods that may adjust an orientation of a charge tube for a perforation assembly, without internal weights and bearings or external lock rings. The systems and methods may include any of the various features disclosed herein, including one or more of the following statements.

Statement 1. An alignment system comprises a first component coupled to a charge tube, the first component operable to rotate in concert with the charge tube, wherein an axis of rotation of the first component extends in a direction of the longitudinal axis of the first component; a second component nested within the first component or disposed within a gun body, wherein the charge tube is movably disposed within the gun body; and an electrical contact extending through the first and second components, wherein the first component is further operable to move in axial directions within the gun body and along the electrical contact to interlock with the second component or separate from the second component.

Statement 2. The system of the statement 1, wherein the first component comprises at least one aperture operable to attach the charge tube to the first component.

Statement 3. The system of the statement 1 or 2, wherein the second component is disposed at an end of the gun body.

Statement 4. The system of any one of the preceding statements, wherein the first component and the second component each comprise a surface operable to interlock.

Statement 5. The system of any one of the preceding statements, wherein the first and second components each comprise a spline.

Statement 6. The system of any one of the preceding statements, wherein the electrical contact comprises a section operable to receive a fastener.

Statement 7. The system of any one of the preceding statements, further comprising the fastener operable to secure the first component with the second component.

Statement 8. The system of any one of the preceding statements, wherein the first component comprises a first mating surface.

Statement 9. The system of any one of the preceding statements, wherein the second component comprises a second mating surface.

Statement 10. The system of any one of the preceding statements, wherein each mating surface comprises interlocking features.

Statement 11. A perforating gun system comprises a gun body; a charge tube movably disposed within the gun body; an alignment assembly comprising: a first component coupled to the charge tube, the first component operable to rotate in concert with the charge tube, wherein an axis of rotation of the first component extends in a direction of the longitudinal axis of the first component; a second component nested within the first component or disposed within a gun body; and an electrical contact extending through the first and second components, wherein the first component is further operable to move in axial directions within the gun body and along the electrical contact to interlock with the second component or separate from the second component.

Statement 12. The system of statement 11, wherein the electrical contact is spring-loaded.

Statement 13. The system of statement 11 or 12, wherein the electrical contact is not spring-loaded.

Statement 14. The system of any one of the statements 11-13, wherein the first component is coaxially aligned with the second component.

Statement 15. The system of any one of the statements 11-14, wherein the first and second components comprise splines.

Statement 16. A method for orienting at least one shaped charge, the method comprising: securing first and second components together with a fastener that is disposed on an electrical contact, wherein the electrical contact passes through the first and second components; attaching the first component to a charge tube; loading the charge tube with the at least one shaped charge; securing the charge tube within the gun body; moving the charge tube in an axial direction to separate the first component from the second component; rotating the charge tube to orient the at least one shaped charge; and moving the charge tube in an opposite direction such that the first component interlocks with the second component within a gun body.

Statement 17. The method of the statement 16, further comprising mating a portion of the first component to a portion of the second component.

Statement 18. The method of the statement 16 or 17, further comprising attaching another perforating gun or other connector to prevent the charge tube from being adjusted.

Statement 19. The method of any one of the statements 16-18, further comprising compressing a spring upon moving the charge tube in a first direction away from the second component.

Statement 20. The method of any one of the statements 16-19, further comprising ratcheting the first component to orient the at least one shaped charge.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Therefore, the present examples are well adapted to attain the ends and advantages mentioned as well as those that are inherent therein. The particular examples disclosed above are illustrative only, as the present examples may be modified and practiced in different but equivalent manners apparent to those skilled in the art having the benefit of the teachings herein. Although individual examples are discussed, all combinations of each example are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure.

What is claimed is:

1. An alignment system comprising:

a first component coupled to a charge tube, the first component operable to rotate in concert with the charge tube, wherein an axis of rotation of the first component extends in a direction of the longitudinal axis of the first component;

a second component nested within the first component or disposed within a gun body, wherein the charge tube is movably disposed within the gun body; and an electrical contact extending through the first and second components, wherein the first component is further operable to move in axial directions within the gun body and along the electrical contact to interlock with the second component or separate from the second component, wherein each component includes at least one tooth configured to allow radial adjustment of the charge tube.

2. The system of claim 1, wherein the first component comprises at least one aperture operable to attach the charge tube to the first component.

3. The system of claim 1, wherein the second component is disposed at an end of the gun body.

4. The system of claim 1, wherein the first component and the second component each comprise a surface operable to interlock.

5. The system of claim 1, wherein the first and second components each comprise a spline.

6. The system of claim 1, wherein the electrical contact comprises a section operable to receive a fastener.

7. The system of claim 6, further comprising the fastener operable to secure the first component with the second component.

8. The system of claim 1, wherein the first component comprises a first mating surface.

9. The system of claim 8, wherein the second component comprises a second mating surface.

10. The system of claim 9, wherein each mating surface comprises interlocking features.

11. A perforating gun system comprising:

a gun body;

a charge tube movably disposed within the gun body;

an alignment assembly comprising:

a first component coupled to the charge tube, the first component operable to rotate in concert with the charge tube, wherein an axis of rotation of the first component extends in a direction of the longitudinal axis of the first component;

a second component nested within the first component or disposed within a gun body; and an electrical contact extending through the first and second components, wherein the first component is further operable to move in axial directions within the gun body and along the electrical contact to interlock with the second component or separate from the second component, wherein each component includes at least one tooth configured to allow radial adjustment of the charge tube.

12. The system of claim 11, wherein the electrical contact is spring-loaded.

13. The system of claim 11, wherein the electrical contact is not spring-loaded.

14. The system of claim 13, wherein the first component is coaxially aligned with the second component.

15. The system of claim 11, wherein the first and second components comprise splines.

16. A method for orienting at least one shaped charge, the method comprising:

securing first and second components together with a fastener that is disposed on an electrical contact, wherein the electrical contact passes through the first and second components;

attaching the first component to a charge tube, wherein each component includes at least one tooth configured to allow radial adjustment of the charge tube;

loading the charge tube with the at least one shaped charge;

securing the charge tube within the gun body;

moving the charge tube in an axial direction to separate the first component from the second component;

rotating the charge tube to orient the at least one shaped charge; and moving the charge tube in an opposite direction such that the first component interlocks with the second component within a gun body.

17. The method of claim 16, further comprising mating a portion of the first component to a portion of the second component.

18. The method of claim 16, further comprising attaching another perforating gun or other connector to prevent the charge tube from being adjusted.

19. The method of claim 16, further comprising compressing a spring upon moving the charge tube in a first direction away from the second component.

20. The method of claim 16, further comprising ratcheting the first component to orient the at least one shaped charge.

* * * * *